US005701567A

United States Patent [19]

Bucks et al.

[11] Patent Number: 5,701,567

[45] Date of Patent: Dec. 23, 1997

[54] COMPLIANT TRANSFER MEMBER HAVING MULTIPLE PARALLEL ELECTRODES AND METHOD OF USING

[75] Inventors: Rodney R. Bucks, Webster; Patricia A. Dwyer, Pittsford; Thomas N. Tombs, Brockport; William B. Vreeland; Robert E. Zeman, both of Webster; John W. May, Rochester, all of N.Y.

[73] Assignee: Eastman Kodak Company, Rochester, N.Y.

[21] Appl. No.: 655,536

[22] Filed: May 30, 1996

[51] Int. Cl.[6] ..... G03G 15/14

[52] U.S. Cl. ..... 399/302; 399/308

[58] Field of Search ..... 399/302, 308, 399/309; 430/33, 44, 126

[56] References Cited

U.S. PATENT DOCUMENTS 4,984,025 1/1991 Landa et al. .
5,084,735 1/1992 Rimai et al. .
5,089,856 2/1992 Landa et al. .
5,132,743 7/1992 Bujese et al. .
5,187,526 2/1993 Zaretsky .
5,276,490 1/1994 Bartholmae et al. .
5,303,013 4/1994 Koike et al. .
5,370,961 12/1994 Zaretsky et al. .
5,438,398 8/1995 Tanigawa et al. .
5,459,560 10/1995 Bartholmae et al. .
5,600,420 2/1997 Saito et al. ..... 399/302

*Primary Examiner*—R. L. Moses
*Attorney, Agent, or Firm*—Norman Rushefsky

[57] ABSTRACT

A transfer member includes separately addressable electrodes separated from the surface of the member by a compliant layer. Preferably, the member is an intermediate transfer member having a thin, hard outer layer usable to receive toner images from an image member and to transfer them to a receiving sheet.

24 Claims, 2 Drawing Sheets

COMPLIANT TRANSFER MEMBER HAVING MULTIPLE PARALLEL ELECTRODES AND METHOD OF USING

This invention relates to the formation of toner images and, more specifically, to an transfer member particularly usable in the formation of toner images and a method of forming toner images using the transfer member.

Non-compliant intermediate transfer members have been used commercially in electrophotographic equipment to transfer toner images from an imaging member to a receiver. They have been used both in single color (black and white) copiers and in color copiers and printers.

U.S. Pat. No. 5,084,735, granted to Rimai et al, and U.S. Pat. No. 5,370,961 to Zaretsky et al, suggest that using an intermediate transfer member having a thick compliant layer with a very thin, hard overcoat greatly improves the transfer efficiency of small toner particles compared to non-compliant intermediate transfer members. The above-mentioned Zaretsky et al patent and Zaretsky U.S. Pat. No. 5,187,526 also point out that best results are obtained if the intermediate transfer member is semi-conducting to optimize the electrostatic force which enables the transfer of toner.

Although compliant intermediates exhibit significant improvements compared to non-compliant intermediates, difficulty still exists due to limitations imposed by air breakdown (ionization) in the vicinity of the transfer nip, both to the intermediate transfer member and away from it to the final receiving sheet. Air breakdown degrades the transfer efficiency and image quality of toner images, especially multicolor images by altering the quantity of charge on the toner particles. In practice, these difficulties are amplified because the compliant intermediates are typically composed of materials that are sensitive to fluctuations in temperature and relative humidity.

U.S. Pat. Nos. 5,276,490 to Bartholmae et al, 5,303,013 to Koike et al, and U.S. Pat. No. 5,459,560 to Bartholmae, granted Oct. 17, 1995, disclose the use of transfer rollers containing multiple parallel electrodes to aid paper handling and also to control the application of an electrical bias during the transfer of toner images.

SUMMARY OF THE INVENTION

We have found that we can substantially improve transfer over the above systems by combining their benefits in an intermediate transfer member that includes a compliant layer, a thin, hard layer on the compliant layer having a surface away from the compliant layer for receiving a toner image and a set of separately addressable electrodes positioned separated from the thin, hard layer by at least a portion of the compliant layer.

It is also an aspect of the invention to use this intermediate transfer member as an intermediate in forming images, especially multicolor images.

According to a preferred embodiment, the compliant layer has a thickness measured from the addressable electrodes to the thin, hard layer of at least 0.5 millimeters. The compliant layer has a Young's modulus less than $10^7$ Pascals and the thin, hard layer has a Young's modulus of at least $10^8$ Pascals. Preferably, the Young's modulus of the compliant layer is between $1\times10^6$ Pascals and $5\times10^6$ Pascals. The thin, hard layer has a thickness less than 50 microns, preferably less than 15 microns and a resistivity greater than $10^5$ ohm-cm. Preferably, the compliant layer has a resistivity divided by the layer's thickness of between $10^5$ ohm and $10^{14}$ ohm with an especially preferred range of between $10^7$ ohm and $10^{10}$ ohm.

DETAILED DESCRIPTION OF THE INVENTION

Figure 1:
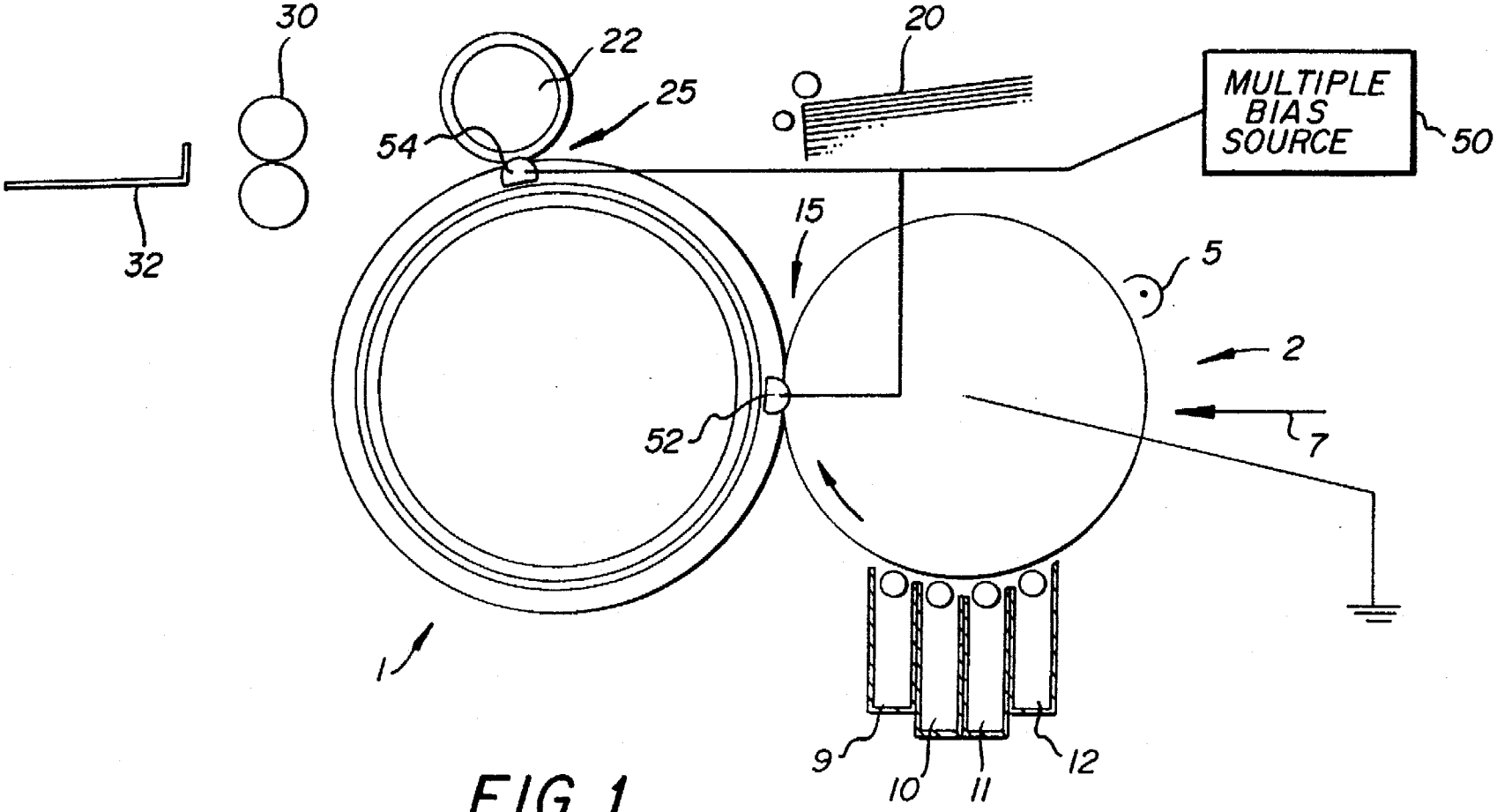
FIG. 1 is a side schematic of an image forming apparatus.

Referring to FIG. 1, an image forming apparatus includes an intermediate transfer member 1 and an image member 2. In general operation, toner images are formed on image member 2 and transferred electrostatically to intermediate transfer member 1. Formation of the toner images on image member 2 is preferably done electrophotographically, although other processes for forming images are known and could be used. Electrophotographically, the image member 2 is photoconductive and is charged at a charging station 5, imagewise exposed at an exposure station, for example, a laser exposure station 7, to form an electrostatic image on the surface of image member 2. The electrostatic image is toned by application of toner from one of toning stations 9, 10, 11 or 12 to form a toner image. Each of toning stations 9, 10, 11 and 12 contain a different color toner so that the color of the toner image can be chosen from one of four colors.

The toner image is transferred from image member 2 to the outside surface of intermediate transfer member 1 electrostatically in a nip 15 by a process which will be discussed in more detail below. The toner image is then or ultimately transferred electrostatically to a receiving sheet fed from a receiving sheet supply 20 to a nip 25 formed between intermediate transfer member 1 and a transfer backing roller 22. The receiving sheet with the toner image is transported to a fuser 30 where it is fixed and ultimately deposited in an output tray 32.

The process just described provides single color images on the receiving sheet. The invention can be used to form single color images, but is particularly advantageous in forming multicolor images. To accomplish this, a series of electrostatic images are formed on image member 2, each of which are toned by a different color toner from stations 9, 10, 11 and 12 to form a series of different color toner images on image member 2. The different color toner images are transferred sequentially in registration to the surface of transfer member 1 where they form a multicolor toner image. The general process described above is conventional and well known in the art.

Figure 2:
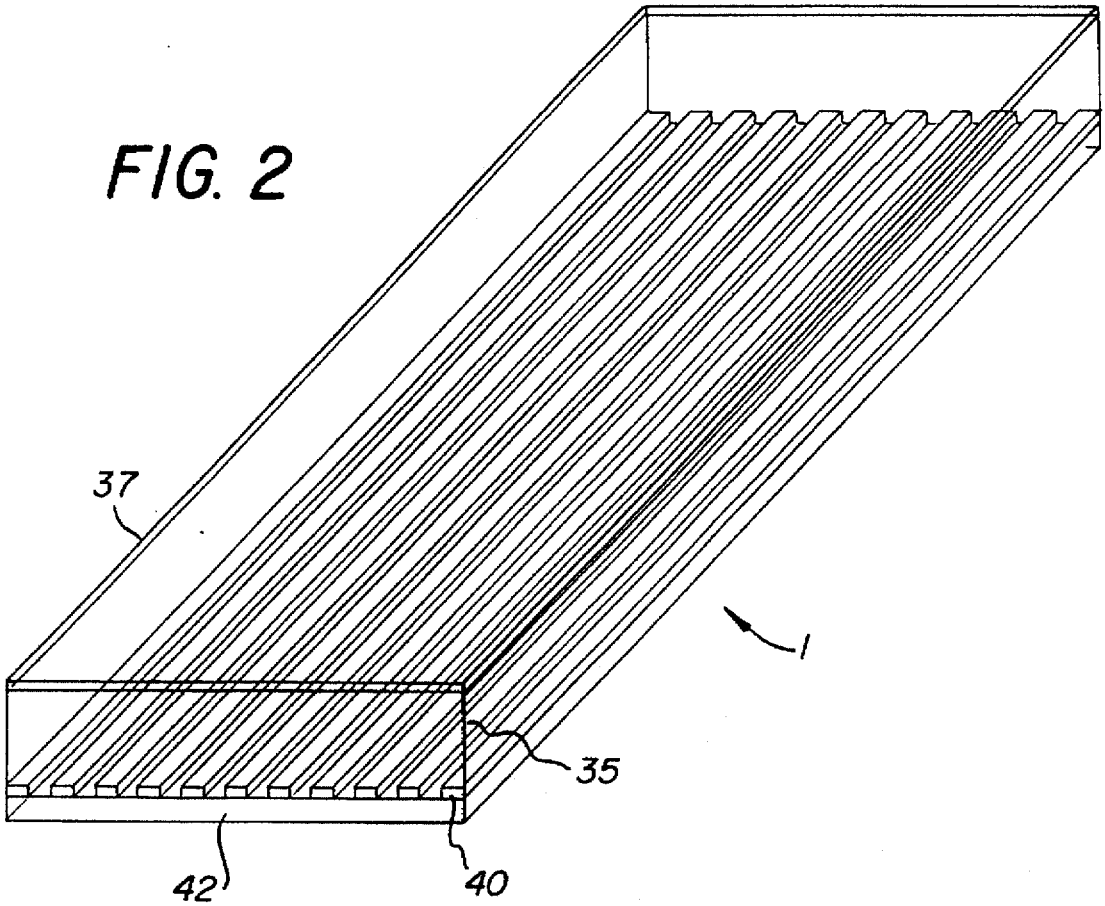
FIGS. 2 and 3 are perspective and cross-sectional views, respectively, of a section of an intermediate transfer member.
Figure 3:
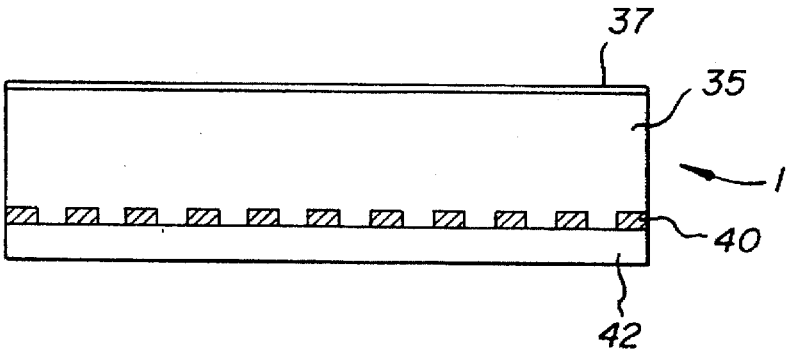

High efficiency transfer of extremely small toner particles desired for multicolor images is one of the most challenging aspects of providing multicolor images electrophotographically. FIGS. 2 and 3 show perspective and cross-section views of transfer member 1 which substantially improves the efficiency and quality of transfer in both nips 15 and 25. Referring to FIGS. 2 and 3, intermediate transfer member 1 includes a compliant layer 35 having a thin, hard overcoat 37. Separately addressable electrodes 40 are substantially separated from the thin, hard overcoat layer by at least a portion of the compliant layer 35. Although the electrodes 40 could be positioned in the middle of layer 35, they are preferably on the bottom edge of layer 35 on or supported by an insulating layer 42. The intermediate transfer member can be a web, belt or roller, depending on the geometry of the apparatus. Thus, insulating layer 32 can be supported by an aluminum roller or polyester web or belt support or the like, well known in the art.

The compliant layer 35 separates the electrodes 40 from the thin, hard overcoat preferably by at least 0.5 millimeters. In some applications, thicknesses greater than 1 millimeter are preferred. The compliant layer 35 further has a Young's modulus less than $10^7$ Pascals, preferably between $1\times10^6$ Pascals and $5\times10^6$ Pascals. Its resistivity divided by its thickness is preferably between $10^5$ ohm and $10^{14}$ ohm with a preferred range between $10^7$ ohm and $10^{10}$ ohm. A conventional polyurethane used for transfer drams per se having a small mount of an antistat material can easily provide these characteristics, as can other elastomeric materials. The thin, hard overcoat layer 37 should have a thickness less than 50 microns, preferably less than 15 microns. It should have a Young's modulus greater than $10^8$ Pascals and a resistivity greater than $10^5$ ohm-cm. Harder polyurethanes, sol-gels, ceramers and fluorinated copolymers are all materials that can be used for overcoats and can be made to provide these characteristics with an appropriate amount of an antistat added to the formulation.

The electrodes are positioned generally parallel to each other and in a cross-track (across the in-track) direction of the transfer member. They can be composed of any suitably conductive material such as copper, nickel or carbon. The electrodes are used to apply an electric field in the transfer nip so that the toner particles transfer from the imaging member to the intermediate transfer member and, subsequently, from the intermediate transfer member to a receiver such as paper. The electrodes are selectively electrically biased so that a large electric field exists at least in part of the transfer nip and a small electric field exists at least in a part of the region just prior to the transfer nip. For example, in a system in which the image member is grounded (conventional), in the region just prior to the transfer nip the electrodes are connected to a ground potential preferably at least 1 millimeter prior to the beginning of the nip (actual contact). In the transfer nip the electrodes, starting from 1 millimeter into the nip and extending to the nip exit or beyond, are set to a full transfer potential at least 200 volts different from the bias applied to the image member and as an example 500 volts. Other variations and sophistications in field control can be worked out by a person skilled in the art and will vary substantially according to the parameters of the system, especially the actual width of the nip. The primary advantage of the invention is to provide a strong transfer field in the nip where the toner is actually contacting the surface to which it is to be transferred while largely eliminating pre-nip ionization. Pre-nip ionization traditionally has caused imaging problems in all transfer systems, but it is especially troublesome when small toners with varying stack heights are to be transferred using a transfer member subject to conductivity variations from humidity and temperature changes.

The electrode structure has a wavelength structure $\lambda$ (essentially the pitch of the electrodes) which should satisfy the following conditions: $\lambda \leqq$ the thickness of the compliant layer divided by x and $\lambda \leqq$ the width of the transfer nip divided by x, where x is 3 but preferably where x is 5. For example, using a transfer nip having a width of 0.5 millimeters and a compliant layer having a thickness of 1 millimeter, the $\lambda$ of the electrodes is preferably not greater than 0.33 millimeters and is much preferably not greater than 0.2 millimeters.

The biases applied to the electrodes are controlled by a multiple bias source 50 which are connected to bias applying structures 52 and 54 for nips 15 and 25, respectively. The application of variable biases to cross-track oriented electrodes has been disclosed in U.S. Pat. No. 5,276,490, granted to Bartholmae et al Jan. 4, 1994, U.S. Pat. No. 5,459,560 to Bartholmae Oct. 17, 1995, and U.S. Pat. No. 5,303,013, granted to Koike et al Apr. 12, 1994, referred to above, which patents are hereby incorporated by reference herein. Typically these biases can be applied by a set of brushes or rollers which contact extensions of the electrodes extending beyond the end of compliant layer 35 and which can be separately biased in the pre-nip, in-nip and post-nip regions to great advantage in transfer field control A similar set of brushes or rollers may be desirable at other stations (for example, an articulatable conductor brush cleaning station (not shown)) to ground or bias the electrodes.

It is believed that the excellent results obtainable with this structure are due to the fact that control of the field can be maintained though the electrodes which are separated from the nip by the compliant layer. This allows the compliant layer to conform to the surface of the image member 2 and the paper or other receiving sheet at nip 25 without interference from the electrodes, thereby assuring excellent contact between the toner and the surface to be transferred to.

The preferred thickness of compliant layer 35 depends on the pressure in the nip. With greater pressure, thinner compliant layers, for example, 1 millimeter thick layers, can be used. For lower pressures, thicknesses of 5 millimeters or more may be preferred.

Further, the hard layer 37 provides desired release characteristics in both accepting the toner from the image member 2 in nip 15 and, more importantly, in releasing it to the receiving sheet in nip 25. Its thinness allows the compliance of layer 35 to be effective.

Although the results are not nearly as dramatic, the transfer member 1 could also be used as a backing roller to a receiving sheet for direct transfer of a toner image to the receiving sheet (attached to member 1), for example, in nip 15. In this instance, the compliance of layer 35 is still useful as is the separate addressability of the electrodes. The hard layer 37 would not be necessary in this embodiment.

The invention has been described in detail with particular reference to a preferred embodiment thereof, but it will be understood that variations and modifications can be effected within the spirit and scope of the invention as described hereinabove and as defined in the appended claims.

We claim:

1. A layered intermediate transfer member comprising a compliant layer, a thin, hard layer on the compliant layer having a surface away from the compliant layer for receiving a toner image and a set of separately addressable electrodes positioned separated from the thin, hard layer by at least a portion of the compliant layer.

2. An intermediate transfer member according to claim 1 wherein the thickness of the compliant layer from the addressable electrodes to the thin, hard layer is at least 0.5 millimeters.

3. An intermediate transfer member according to claim 1 wherein the compliant layer has a Young's modulus less than $10^7$ Pascals and the thin, hard layer has a Young's modulus of at least $10^8$ Pascals.

4. An intermediate transfer member according to claim 3 wherein the compliant layer has a thickness greater than 0.5 millimeters measured between the addressable electrodes and the thin, hard layer, a Young's modulus of between $1\times10^6$ Pascals and $5\times10^6$ Pascals and a resistivity divided by its thickness which is between $10^5$ ohms and $10^{14}$ ohms.

5. An intermediate transfer member according to claim 1 wherein the thin, hard layer has a thickness less than 50 microns, a Young's modulus of greater than $10^8$ Pascals and a resistivity greater than $10^5$ ohm-cm.

6. An intermediate transfer member according to claim 1 wherein the surface for receiving the toner image is movable in an in-track direction and wherein the separately addressable electrodes are positioned across the in-track direction.

7. An intermediate transfer member according to claim 6 wherein the electrode structure has a characteristic wavelength $\lambda$ which is less than or equal to the thickness of the compliant layer divided by 3.

8. An intermediate transfer member according to claim 1 further including an insulating backing for the separately addressable electrodes.

9. An intermediate transfer member according to claim 1 wherein the compliant layer has a resistivity divided by the compliant layer's thickness between $10^5$ ohms and $10^{14}$ ohms.

10. An intermediate transfer member according to claim 9 wherein said compliant layer's resistivity divided by its thickness is between $10^7$ ohms and $10^{10}$ ohms.

11. An intermediate transfer member according to claim 1 wherein the thin, hard layer has a thickness less than 15 microns, a Young's modulus greater than $10^8$ Pascals and a resistivity greater than $10^5$ ohms-cm.

12. An intermediate transfer member according to claim 6 wherein the electrode structure has a characteristic wavelength $\lambda$ which is less than the thickness of the compliant layer divided by 5.

13. An intermediate transfer member according to claim 1 wherein the compliant layer has a Young's modulus of between $1\times10^6$ Pascals and $5\times10^6$ Pascals and the compliant layer has a resistivity divided by the compliant layer's thickness between $10^7$ ohm and $10^{10}$ ohm and the thin, hard layer has a thickness less than 15 microns and a Young's modulus greater than $10^8$ Pascals and a resistivity greater than $10^5$ ohm-cm and the compliant layer has a thickness measured from the addressable electrodes to the thin, hard layer of at least 0.5 millimeters.

14. For use in transferring a toner image from an image member to a first side of the receiving sheet, a backing member having a contacting surface for contacting a second side of the receiving sheet opposite the first side, said backing member comprising a compliant layer and a set of separately addressable electrodes separated from the contacting surface of the backing member by at least a portion of the compliant layer.

15. The backing member according to claim 14 wherein the backing member is a roller and the electrodes are separated from the contacting surface by at least 0.5 millimeters.

16. An image forming method comprising:

forming a toner image on an image member, providing a transfer nip between the image member and a layered intermediate transfer member, the intermediate transfer member including a compliant layer, a thin, hard layer on the compliant layer having a surface away from the compliant layer for receiving a toner image and a set of separately addressable electrodes positioned separated from the thin, hard layer by at least a portion of the compliant layer;

electrostatically transferring the toner image from the image member to the transfer member in the presence of an electrical field between the image member and the separately addressable electrodes.

17. An image forming method according to claim 16 wherein the nip has a width in an in-track direction n and wherein the characteristic wavelength $\lambda$ of the electrode structure complies with the following inequalities:

$\lambda \leqq$ the thickness of the compliant layer divided by x, and $\lambda \leqq$ the width of the transfer nip divided by x, where x is 3.

18. An image forming method according to claim 16 wherein the nip has a width in an in-track direction n and wherein the characteristic wavelength $\lambda$ of the electrode structure complies with the following inequalities:

$\lambda \leqq$ the thickness of the compliant layer divided by x, and $\lambda \leqq$ the width of the transfer nip divided by x, where x is 5.

19. An image forming method according to claim 16 wherein the transfer nip includes an in-nip region in which the transfer member and image member are in contact and a pre-nip region immediately preceding the in-nip region in the in-track direction and the method includes applying a transfer bias selectively to the electrodes relative to a bias on the image member to provide a high electric field in at least a portion of the in-nip region and a low electric field in the pre-nip region.

20. An image forming method according to claim 19 Wherein the bias applied to the electrodes controlling the field in the in-nip region is at least 200 volts different from the bias applied to the image member, which voltage is set to last from a position at least one millimeter into the nip to a position at least the nip exit.

21. An image forming method according to claim 20 wherein the electrodes controlling the field in the pre-nip region are biased at the same potential as the conducting layer of the image member.

22. An image forming method according to claim 16 further including transferring a series of different colored images to the transfer member in registration to form a multicolor image.

23. An image forming method according to claim 16 further including electrostatically transferring the toner image from the transfer member to a receiving sheet.

24. An image forming method according to claim 22 further including electrostatically transferring the multicolor image from the transfer member to a receiving sheet.

* * * * *

UNITED STATES PATENT AND TRADEMARK OFFICE

CERTIFICATE OF CORRECTION

PATENT NO. : 5,701,567

DATED : Dec. 23, 1997

INVENTOR(S) : Rodney R. Bucks et al.

It is certified that error appears in the above-identified patent and that said Letters Patent is hereby corrected as shown below:

Title page insert the following --[60] Provisional Application No. 60/005,957, Oct. 27, 1995--.

Column 1, line 4, after the title, insert the following:
--CROSS REFERENCE TO RELATED APPLICATION
Reference is made to and priority claimed from U.S. Provisional Application Ser. No. 60/005,957, filed Oct. 27, 1995, entitled COMPLIANT TRANSFER MEMBER HAVING MULTIPLE PARALLEL ELECTRODES AND METHOD OF USING--.

Signed and Sealed this

Twenty-ninth Day of June, 1999

*Attest:*

*Attesting Officer*

Q. TODD DICKINSON

*Acting Commissioner of Patents and Trademarks*